United States Patent [19]

Hunziker et al.

[11] 4,090,076

[45] May 16, 1978

[54] HIGH RESOLUTION ELECTRON ENERGY DEVICE AND METHOD

[75] Inventors: Heinrich Erwin Hunziker, Saratoga; Robert Kenyon Nesbet, Los Gatos, both of Calif.

[73] Assignee: International Business Machines Corporation, Armonk, N.Y.

[21] Appl. No.: 705,982

[22] Filed: Jul. 16, 1976

[51] Int. Cl.[2] ..... H01J 39/00

[52] U.S. Cl. ..... 250/305

[58] Field of Search ..... 250/305, 310, 427

[56] References Cited

U.S. PATENT DOCUMENTS

| | | | |
|---|---|---|---|
| 3,582,648 | 6/1971 | Anderson et al. | 250/305 |
| 3,670,172 | 6/1972 | Golden | 250/305 |
| 3,769,513 | 10/1973 | Delany | 250/427 |
| 3,806,728 | 4/1974 | Lindholm et al. | 250/305 |
| 3,836,775 | 9/1974 | Ridgway | 250/305 |

OTHER PUBLICATIONS

Cvejanovic et al., "A New Technique for Threshold Excitation Spectroscopy", J. Phy. B: Atom MLec, Phys., vol. 7, No. 10, 1974, pp. 1180–1193.

*Primary Examiner*—Bruce C. Anderson
*Attorney, Agent, or Firm*—Joseph E. Kieninger

[57] ABSTRACT

A device and method for obtaining high resolution of electron energy in an electron beam is described. The device has a resonance chamber containing a gas which exhibits a narrow scattering resonance at a specific electron energy value. The device utilizes the narrow resonance property of the gas to filter the electron energy spectrum at that energy value. A preferred embodiment is a spectrometer having an electron accelerator, an electromagnetic filter, a resonance chamber containing helium, and a trapped electron detector device. The electrons in the beam are accelerated and the beam is passed through an electromagnetic filter centered at approximately 20.614 eV. The filtered beam passes into a resonance chamber where the electrons have inelastic collisions with the helium atoms to produce the $He2^1S$ excited state. The $He2^1S$ scattering resonance has a narrow width of less than 0.001 eV at its energy threshold of 20.614 eV and serves as a filter. Due to the steepness of the initial rise of the resonance structure the resolution of the spectrometer is about 0.0001 eV. The trapped electron device then detects the flux density of the scattered electrons.

14 Claims, 8 Drawing Figures

HIGH RESOLUTION ELECTRON ENERGY DEVICE AND METHOD

FIELD OF THE INVENTION

This invention relates to devices concerned with electron beams and more particularly to a method and apparatus for obtaining a high degree of resolution of electron energy in an electron beam.

BRIEF DESCRIPTION OF PRIOR ART

Electron spectrometers are used to analyze the electrons emitted from a source with respect to their kinetic energy. Electron filters are devices which selectively pass or stop electrons of a certain energy or energies. The resolution of a filter or spectrometer may be expressed as $\Delta E$, the energy spread of the electrons transmitted, trapped, removed or detected.

One type of spectrometer which is suitable for use with electrons of low energy is based on the time of flight principle. The velocity of the electrons is measured by determining the time it takes for them to traverse a drift tube. The energy distribution to be analyzed is converted into a distribution in arrival time at the detector. The resolution, $\Delta E$, of these devices is about 10 mV.

A second type of spectrometer is an electromagnetic device, based on dispersing electrons with electric and/or magnetic fields according to their kinetic energy. These are variable band pass electron filters which pass a certain energy band whose center can be continuously varied. Typical examples of electromagnetic devices are the electrostatic spherical and cylindrical analyzers, the cylindrical mirror analyzer, the concentric spherical grid analyzer, and the Wien filter. One such spectrometer is described in the patent to Green et al U.S. Pat. No. 3,733,483. In general the resolution, E, of electromagnetic devices is of the order of 10 to 20 mV.

A third type of spectrometer is the trapped electron device. With these devices all electrons below a certain variable energy are trapped in an electrostatic potential well and are collectively detected. The resolution, $\Delta E$, of trapped electron devices is usually between 0.05 and 0.4 V and is generally inferior to the electromagnetic devices. The trapped electron device of Cvejanovic and Read described in Journal of Physics, B, I, 7, 1180 (1974) is an exception, however, since it has a resolution, $\Delta E$, of 10 mV.

Still another type of spectrometer uses materials such as $SF_6$ and $C_2H_5NO_3$ to form negative ions which are subsequently detected. These negative ion type spectrometers are limited to electrons having an energy near zero and have a resolution, $\Delta E$, which is even lower than the trapped electron devices.

One of the principal goals in the development of electron spectrometers in improved resolution, $\Delta E$, at a useful output. Higher resolution will permit qualitatively new scientific information to be obtained, and it is of great practical importance in applications such as X-ray photoelectron spectroscopy to distinguish between atoms of the same kind in different chemical binding states, i.e., for structure determination of materials. Efforts to improve resolution in the past have been made primarily by increasing the effectiveness of the individual parts and/or functions thereof of existing spectroscopic instruments.

SUMMARY OF THE INVENTION

It is a primary object of this invention to provide an apparatus and/or method for obtaining high resolution of electron energy in electron beams.

It is another object of this invention to provide an improved spectrometry.

It is yet another object of this invention to provide an improved narrow band stop filter device.

These and other objects are accomplished by a method and device having a resonance chamber containing a gas which exhibits a narrow scattering resonance at a specific electron energy value. The narrow resonance property of the gas filters the electron energy spectrum or distribution at that resonance energy value. The invention can be utilized as a method for obtaining a high degree of resolution of electron energy in an electron beam or it can be implemented in an electron spectrometer or a narrow band stop filter device. A preferred embodiment is a spectrometer having an electron accelerator, an electromagnetic filter, a resonance chamber containing helium, and a trapped electron detector device. The electrons in the beam are accelerated and the beam is passed through an electromagnetic filter centered at approximately 20.614 eV. The filtered beam passes into a resonance chamber where the electrons have inelastic collisions with the helium atoms to produce the $He2^1S$ excited state. The $He2^1S$ scattering resonance has a narrow width of less than 0.001 eV at its energy threshold of 20.614 eV and serves as a filter. Due to the steepness of the initial rise of the resonance structure the resolution of the spectrometer is about 0.0001 eV. The trapped electron device then detects the flux of the inelastically scattered electrons.

Other objects of this invention wil be apparent from the following detailed description, reference being made to the accompanying drawings wherein a preferred embodiment of the invention is shown.

DESCRIPTION OF THE ILLUSTRATIVE EMBODIMENTS

High resolution of electron energy in an electron beam is obtained by making use of a materials property, that is, the narrow resonance of certain gases. The narrow scattering resonance of a gas at a specific electron energy value is used to filter the electron energy spectrum at that energy value. This invention is particularly useful in a spectrometer or in a narrow band stop filter device.

Figure 1:
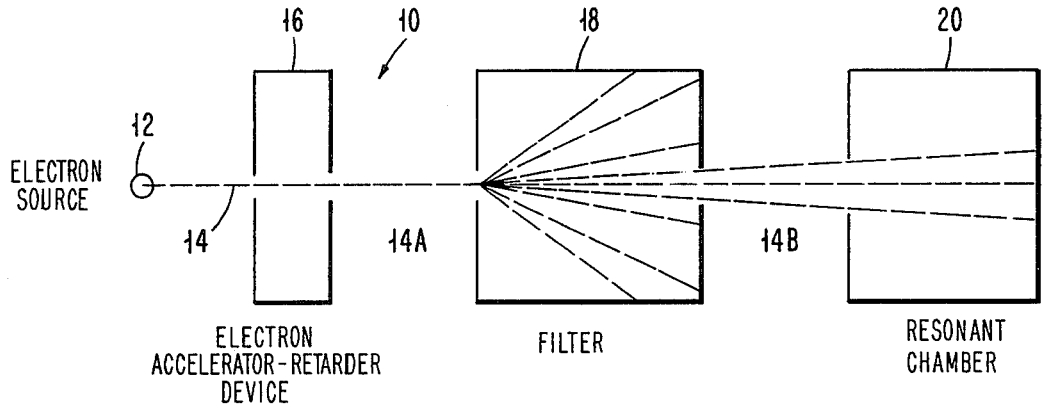
FIG. 1 is a schematic view of a high resolution spectrometer employing inelastic scattering resonance.

As shown in FIG. 1 this invention can be used in a spectrometer 10 employing inelastic scattering resonance. An electron source 12 emits electrons 14 which are passed into an accelerating or retardation means or device 16. The electron source 12 may be of many different types. For example, electron source 12 may be a material exposed to electromagnetic or particle radiation, that is, ultraviolet, x-rays, electron beams, and ion beams. The electron source 12 may also be a plasma or a material heated to high temperatures (i.e., a cathode). Electron source 12 may also be formed by a nuclear reaction such as beta-decay.

Figure 3A:
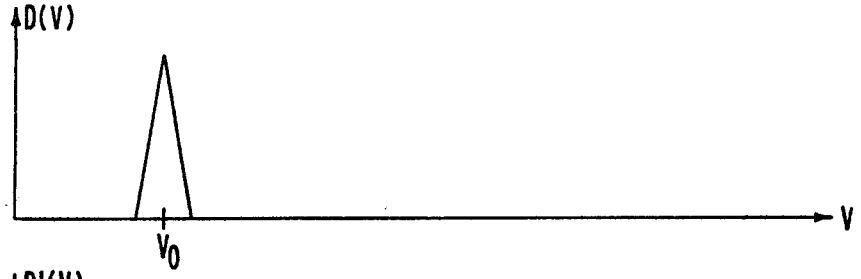
FIG. 3*a* is an example of the energy distribution of an electron source centered at a voltage $V_0$.

The energy spectrum of different electron sources 12 have an infinite number of energy spectral shapes. One non-limiting example of an energy spectrum of a specific energy source 12 is shown in FIG. 3*a*, centered at a certain energy value, $V_0$. It is understood that the energy spectrum illustrated in FIG. 3*a* has an inifinite resolution not presently obtainable by existing energy resolution means.

The accelerating or retarding device 16 typically utilizes variable electrostatic potentials as is well known in practice in the art. Any acceleration or retardation means 16 may be used in the practice of this invention as long as it is compatible with the other components in the spectrometer 10. The accelerating device 16 is used to change or move the energy spectrum from a position $V_0$ as shown in FIG. 3*a* to different positions, for example, positions $V_1$, $V_2$, $V_3$, $V_4$ and $V_5$ as shown in FIG. 3*b*.

The electron beam 14A passes from the device 16 into an electromagnetic device or filter 18. The electromagnetic device 18 is of the second type of spectrometer referred to earlier which disperses electrons with electric and/or magnetic fields according to their kinetic energy. The electromagnetic device 18 filters an energy spectrum in a well defined manner such as that disclosed in FIG. 3*c* where device 18, whose transmission is centered at $V_r$ volts, transmits electron energies from a lower limit of $V_l$ to an upper limit of $V_u$. Transmission curves such as shown in FIG. 3*c* are typical and are well known in the art.

Figure 3B:
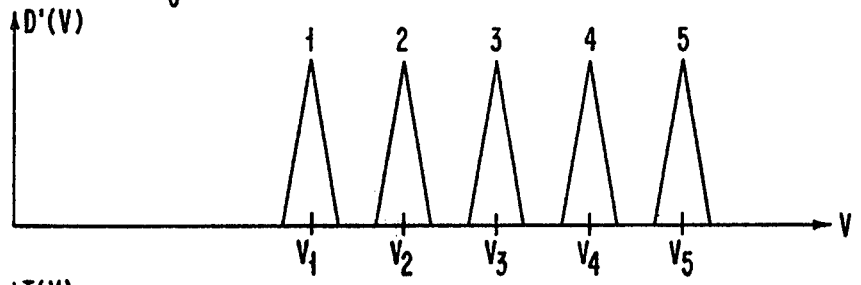
FIG. 3*b* is an energy distribution of the same electron source as in FIG. 3*a* shifted to $V_1$, $V_2$, $V_3$, $V_4$ and $V_5$ voltages.
Figure 3C:
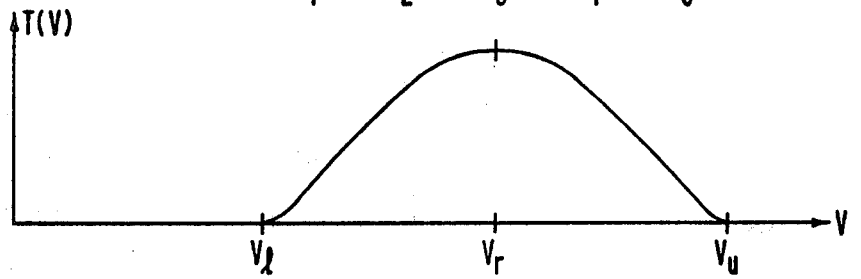
FIG. 3*c* is a plot illustrating the transmission of an electromagnetic filter centered at $V_r$ ($V_r$=20.614 ev).
Figure 3D:
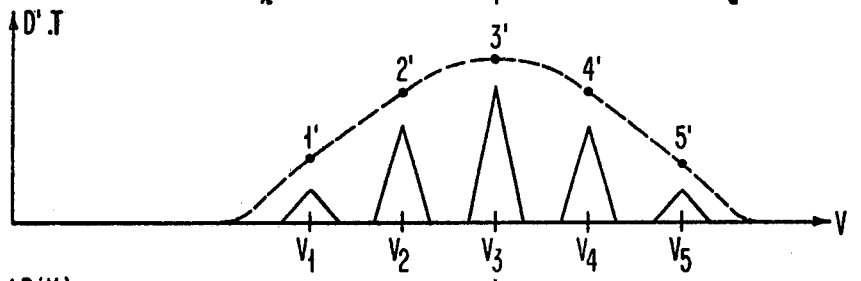
FIG. 3*d* illustrates the shifted energy distributions at $V_1$, $V_2$, $V_3$, $V_4$ and $V_5$ after the filtering according to FIG. 3*c*.

FIG. 3*d* illustrates the shifted energy distributions at points 1, 2, 3, 4 and 5 of the energy scale illustrated in FIG. 3*b* at the exit of the filter 18. Points 1 through 5 represent the total electron current through the filter 18 for each energy spectrum set forth in FIG. 3*b*. It is understood that the energy spectrums shown in FIG. 3*d* at $V_1$, $V_2$, $V_3$, $V_4$ and $V_5$ pictorially illustrates the energy spectra of FIG. 3*b* as filtered by the device 18. However, these energy spectra are not obtained when measuring the total current through device 18 due to the relatively poor resolution of the filter 18. Only the points 1, 2, 3, 4 and 5 are obtained. The dashed line through points 1 through 5 applies for continuous variations of the voltage.

In accordance with this invention the filtered electron beam 14B is passed into the resonant chamber 20 as shown in FIG. 1. The resonance chamber 20 contains a gas which exhibits a narrow scattering resonance at a specific electron energy value. Helium is the gas used in the preferred embodiment of this invenion. Helium undergoes the following reaction:

$$He\,(1^1S) + e\,(V=20.614 + \Delta V) \rightarrow He\,(2^1S) + e\,(V=\Delta V)$$

Figure 3E:
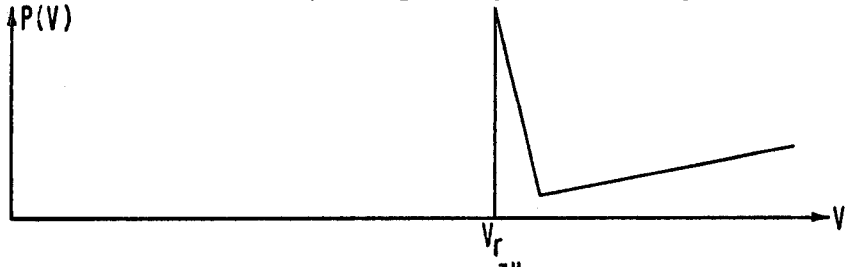
FIG. 3*e* is the inelastic scattering probability characteristic of the $He2^1S$ resonance where $V_r$=20.614 volts.

The He ($2^1S$) resonant threshold is at a voltage of 20.614 volts. A He ($2^1S$) resonance scattering probability curve is shown in FIG. 3*e*. As can be seen from FIG. 3*e* this resonance scattering process has a high probability, P(V), for only a very small range about 0.0011 eV knowing the response curve of the detector, in this case FIG. 3*e*, the original energy distribution can be obtained by well know inversion procedures. The resolution of this inversion is determined by the steepest feature of the detector response curve. The steepness of P(V) increasing from 0 to its maximum width in about 0.0001 eV is resonsible for the spectrometer having a high degree of resolution, that is, about 0.0001 eV. The purpose of the electromagnetic filter 18 is to single out the resonance at $V_r$ for detection in the detector device 20. Thus in the preferred embodiment, when using the He$2^1S$ resonance, the inelastically scattered electrons will have energy values, V, between 0 and $V_u$–$V_r$. If device 20 is a trapped electron filter, its well depth will be adjusted accordingly to detect only energy values between 0 and $V_u$–$V_r$. If device 20 is a metastable atom detector, only He$2^1S$ atoms will be detected since only this resonance lies within the passband of the filter 18, i.e., between the energy values $V_l$ and $V_r$.

The electrons in the beam 14B enter the resonant chamber 20 and have inelastic collisions with the helium atoms with transfer of energy. The helium atom which was in its lowest energy state absorbs energy from the electron beam and is left in an excited state, the He ($2^1S$) state for example. The scattered electrons lose a corresponding amount of energy. The rate of scattering varies rapidly as a function of the electron energy. Prominent structures of very narrow energy width occur in the scattering rate as a result of the transient electron attachment to the target atom or molecule, for example, helium. Such structures in the scattering rate as a function of impact energy are known as resonance and this term will include the special structures commonly known as virtual states. The He $2^1S$ resonant state is one example. Another example of a gas and corresponding resonance state usable in this application is helium and the He$2^3S$ state at an energy threshold of 19.818 electron volts.

Gases other than helium may be used in the practice of this invention. A general survey of resonances in electron scattering by atoms and diatomic molecules is reported by G. J. Schulz in the Review of Modern Physics, Vol. 45, pp. 378–422 and pp. 423–486, (1973) "Resonances in Electron Impact on Atoms" and "Resonances in Electron Impact on Diatomic Molecules". The examples cited in these articles are included herewith by reference thereto.

The inelastic scattering may be detected by measuring the rate of production of excited atoms or molecules, or by detecting low energy electrons slowed down by the inelastic collision. The He$2^1S$ state is metastable in the sense that its rate of decay by radiation is very small. As a result, the excitation energy is preferentially lost by collision with other atoms or molecules or with the walls of a containing vessel. Metastable atoms such as He$2^1S$ can readily be detected by known techniques. In FIG. 1 the spectrometer 10 can detect the occurrence of a resonance by using a trapped electron device or a metastable atom detector. In the case of a trapped electron device, it is the usual practice for such a device to include a resonance chamber. As a result, in FIG. 1 the device 20 could be considered a trapped electron device containing a resonance chamber. As mentioned previously a mestable atom detector which is a well known device based upon the ejection of electrons from a metal surface by energetic species may be used in combination with the resonance chamber 20. If the metastable atom detector is employed, the electrically neutral metastable atoms such as the He2$^1$S atoms are separated from the incident and scattered electrons by a suitable arrangement of grid electrodes with associated electrostatic potentials.

Figure 3F:
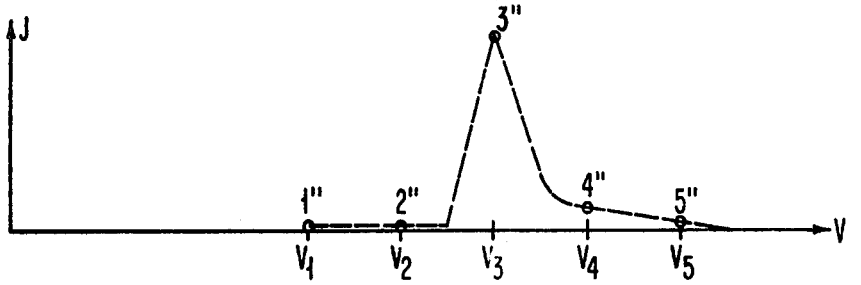
FIG. 3*f* illustrates the current, J, of low energy electrons collected in the trapped electron device after filtering according to FIG. 3*c* and FIG. 3*e*.

In FIG. 3*f* the current J of the low energy electrons collected in the trapped electron device associated with the resonance chamber 20 is plotted. Points 1'', 2'', 3'', 4'' and 5'' correspond to the points 1', 2', 3', 4' and 5' obtained by electromagnetic filtering at the five points on the energy scale 1, 2, 3, 4 and 5 shown in FIG. 3*b*. The dashed line in FIG. 3*f* applies for a continuous variation of V and clearly distinguishes the effectiveness of the filtering of the entire device when compared with the filtering effected by the electromagnetic filter alone as shown by the dashed line in FIG. 3*d*.

A high degree of resolution, that is 0.0001 volts, is effected by the combination of filtering by the electromagnetic filter specified by FIG. 3*c* and the filtering by the resonance spectrum as shown in FIG. 3*e*.

While not shown in FIG. 1 it is understood that depending upon the collimation of the electrons emitted by the source 12 it will be necessary to include electrostatic or electromagnetic focusing devices in some or all of the transition regions between the source 12 and means 16, means 16 and filter 18, and filter 18 and chamber 20. The focussing devices, device 16 and the filter 18 have to be designed in such a way that their potentials do not blur the energy distribution of the transmitted electrons by more than 0.0001 eV.

The spectrometer disclosed in FIG. 1 can be modified to place the accelerating device 16 between the filter 18 and the resonance chamber 20. With this type of arrangement the center of the bandpass of filter 18, designated $V_p$, which was set at $V_p = V_r$(20.614 eV) when utilizing the He2$^1$S resonance, is now continuously varied, together with the accelerating potential $V_a$, in such a way that the resonance condition $$V_p + V_a = V_r$$

is always fulfilled. The same type of detector means may be associated with the resonance chamber 20 as previously described.

Figure 2:
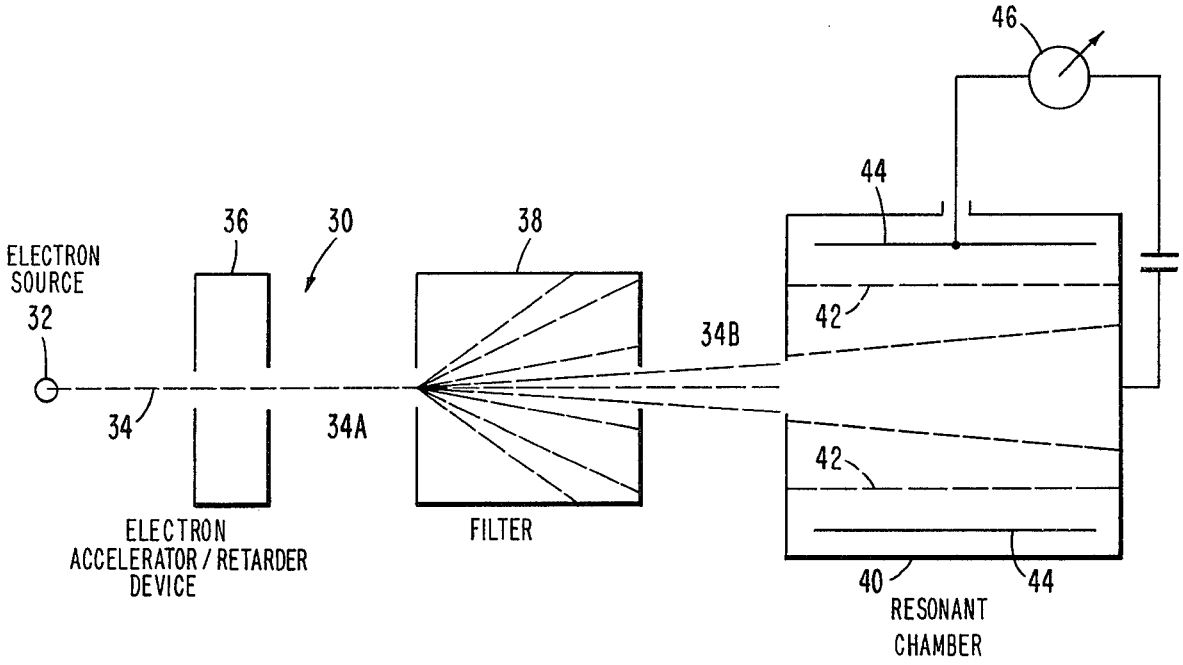
FIG. 2 is a schematic view of a high resolution spectrometer employing elastic scattering resonance.

Another embodiment involves the use of an elastic scattering resonance of narrow energy width instead of an inelastic scattering resonance as shown in FIG. 2. Elastic scattering occurs with no transfer of energy between the electrons and atoms. In FIG. 2 a spectrometer 30 has an electron source 32 which gives off a beam of electrons 34. The electrons 34 pass into the accelerating or retardation device 36. The electron beam 34A leaves the device 36 and passes into the electromagnetic filter 38. Electrons 34B leave the filter 38 and pass into a resonance chamber 40. The resonance chamber 40 contains a gas at a pressure less than atmospheric which has an elastic scattering resonance of narrow energy width. A non-limiting example of a detection means inside the resonance chamber 40 includes a cylindrical grid 42 and a cylindrical collection electrode 44. The collection electrode is at a potential $V_r$ relative to the wall of the scattering chamber 40 and grid 42. Means 46 measures the current, J, of the elastically scattered electrons reaching electrode 44. The inelastically scattered electrons in this arrangement do not have sufficient energy to reach electrode 44. This arrangement detects only those electrons which retain their incident energy close to $V_r$ at which the elastic scattering resonance occurs but which are deflected from the direction of incidence by elastic scattering.

This invention can be also employed to form a narrow bandstop electron energy filter. In this type of arrangement a resonance chamber is filled with a gas such as helium at low pressure or with another gas exhibiting a narrow scattering resonance and is placed directly into the electron beam to be filtered. The electron distribution emerging from the chamber in the forward direction of the incident beam will be deficient in electrons of energy near $V_r$, the resonance energy, with a bandwidth depending on the width of the resonance. For example, a beam can be freed of electrons of energy 20.614 volts by passing it through a chamber containing helium. The electrons will be filtered with a bandwidth of about 0.001 eV.

Although a preferred embodiment of this invention has been described, it is understood that numerous variations may be made in accordance with the principles of this invention.

I claim:

1. An electron spectrometer adapted to analyze the kinetic energy of electrons emitted from a sample comprising first means for varying the energy value of electrons from said sample to bring the energy value of said electrons to a range which includes the energy value of the resonance of a detector gas, a resonance chamber associated with said first means containing a detector gas adapted to exhibit a narrow scattering resonance at a specific energy value wherein said narrow resonance of said detector gas filters the electron energy spectrum in the vicinity of said specific energy value to emit particles resulting from the scattering process, and detector means associated with said chamber adapted to detect the presence of said emitted particles.

2. An electron spectrometer as described in claim 1 wherein said detector means detects inelastic scattering at said specific energy value.

3. An electron spectrometer as described in claim 1 wherein said detector means detects elastic scattering.

4. An electron spectrometer as described in claim 1 wherein said detector means is a trapped electron device.

5. An electron spectrometer as described in claim 1 wherein said detector means is a metastable atom detector.

6. An electron spectrometer as described in claim 1 wherein said detector gas is helium and said specific energy value is about 20.614 volts.

7. An electron spectrometer as described in claim 1 including electron focusing devices.

8. An electron spectrometer as described in claim 1 including second means positioned between said first means and said resonance chamber and adapted to electromagnetically filter electrons from said first means.

9. A method of analyzing the kinetic energy of electrons emitted from a sample comprising the steps of varying the energy value of electrons from said sample to a range which includes the energy value of the resonance of a detector gas, passing the electrons into a resonance chamber containing a detector gas adapted to exhibit a narrow scattering resonance at a specific energy value whereby said narrow resonance of said detector gas filters the electron energy spectrum in the vicinity of said specific energy value to emit particles resulting from the scattering process, and detecting the presence of said emitted particles.

10. A method as described in claim 9 including the step of electromagnetically filtering the electrons after they have attained the energy value of the resonance of a detector gas and prior to being passed into said resonance chamber.

11. A method as described in claim 9 whereby the detector gas is helium.

12. A method as described in claim 9 whereby scattered electrons are the emitted particles that are detected.

13. A method as described in claim 9 whereby excited atoms are the emitted particles that are detected.

14. A method as described in claim 9 whereby excited molecules are the emitted particles that are detected.

* * * * *